US005604964A

United States Patent [19]

Aoshima

[11] Patent Number: 5,604,964

[45] Date of Patent: Feb. 25, 1997

[54] BUCKLE

[75] Inventor: Tomoaki Aoshima, Hamamatsu, Japan

[73] Assignee: Nifco, Inc., Yokohama, Japan

[21] Appl. No.: 613,705

[22] Filed: Mar. 11, 1996

[30] Foreign Application Priority Data

Mar. 28, 1995 [JP] Japan ..... 7-093247

[51] Int. Cl.[6] ..... A44B 11/00

[52] U.S. Cl. ..... 24/632; 24/633; 24/637

[58] Field of Search ..... 24/632, 633, 630, 24/631, 637, 573.5; 297/468

[56] References Cited

U.S. PATENT DOCUMENTS

| | | | |
|---|---|---|---|
| 3,639,948 | 2/1972 | Sherman | 24/632 |
| 4,742,604 | 5/1988 | Mazelsky | 24/573.5 |
| 5,086,548 | 2/1992 | Tanaka et al. | 24/632 |
| 5,438,737 | 8/1995 | Anscher et al. | 24/630 |

FOREIGN PATENT DOCUMENTS

| | | |
|---|---|---|
| 61-147012 | 9/1986 | Japan . |
| 6-284916 | 10/1994 | Japan . |

*Primary Examiner*—Victor N. Sakran
*Attorney, Agent, or Firm*—Schwartz & Weinrieb

[57] ABSTRACT

A buckle includes a female member having a main body provided at opposite ends with sockets, a belt retainer adapted for fastening one end of a belt thereto and provided on one side of the main body so as to extend between the sockets, an engaging member having engaging claws facing the sockets and projecting toward the belt retainer and elastic pieces which urge the engaging member toward the belt retainer, and a window for allowing a portion of the engaging member to project downward; and a pair of male members adapted for fastening one end of a pair of belts and insertable into the sockets of the main body to be retained thereby, each male member having an insert formed with an engaging claw which projects toward the inner wall of the main body on the side thereof opposite from the belt retainer and engages with the associated engaging claw of the engaging member when the male member is inserted into the associated socket, the engagement between the engaging claws of the female member and the engaging claws of the male members being releasable by pressing the portion of the engaging member projecting through the window toward the inner wall.

18 Claims, 18 Drawing Sheets

BUCKLE

BACKGROUND OF THE INVENTION

1. Field of the Invention

This invention relates to a buckle for joining the ends of three belts, and more particularly to a buckle comprising a pair of male members adapted for fastening one end of each one of first and second belts, and a female member for retaining the pair of male members and adapted for fastening one end of a third belt.

2. Description of the Prior Art

Prior-art buckles for joining the ends of three belts include, for example, the belt connecter taught by Japanese Utility Model Public Disclosure Sho 61-147012, and the buckle device taught by Japanese Patent Public Disclosure Hei 6-284916.

The belt connector disclosed in Utility Model Public Disclosure Sho 61-147012 comprises a case connected with one belt and inserts connected with the other belts. A plate spring is provided inside the case for clamping the inserted inserts between the plate spring itself and the case, and an operating member is provided upon the front surface of the case for releasing the engagement between the inserts and the case by flexing the plate spring away from the inserts so as to separate the inserts from the plate spring.

The buckle device disclosed in Japanese Patent Public Disclosure Hei 6-284916 comprises a buckle body and a pair of tongue plates. Each one of a pair of engaging members provided inside the buckle body is spring biased to independently engage one of the tongue plates. The front of the buckle body is provided with a button plate movably supported on a base member of the buckle body so as to enable release of the tongue plates by pressing down on the button plate so as to press down on and move the pair of engaging members.

Since the aforementioned belt connector joins the belts by clamping the inserts between the plate spring and the case, release of the engagement requires the plate spring to be moved about a pivot point between the plate spring and the case. In order to render the belt connector of this configuration easy to use, the case has to be of a flat or thin box-like shape and, as shown in FIG. 1 of Utility Model Public Disclosure Sho 61-147012, the plate spring has to be pivotably fastened to one side of the case with its distal end located on the front side of the case. As a result, the release of the engagement has to be achieved by use of an arrangement having an operating member linked with the plate spring in a such manner that the plate spring is pressed away from the front of the case toward the back thereof when the operating member is pressed inward.

The aforesaid buckle device similarly requires the engaging members, for releasing the engagement of the tongue plates, to be pivotably fastened to one side of the buckle body with their distal ends located on the front side of the buckle body. As a result, the release of the engagement has to be achieved by use of an arrangement in which the engaging members are pressed away from the front of the case toward the back thereof by means of the button plate when the button plate is pressed inward.

When a belt connector or the like of this type is used for joining belts to secure a person in a seat or the like, the rear surface of the main body of the belt connector comes in contact with the abdomen of the wearer. When the operating member or the like is pressed inward from the front of the main body toward the rear thereof in order to release the belts, therefore, the belt wearer experiences pressure on the abdomen. This is particularly a problem when a belt connector of this type is used for securing a baby or small child in a stroller, vehicle child seat or the like because the pressure exerted on the abdomen when the operating member is pressed inward causes the baby or child considerable discomfort. An improved belt connector has therefore been desired.

Moreover, since the rear surface of a belt connector of this type comes into contact with a soft region of the wearer's abdomen, the pressure applied to the operating member or the like often causes the belt connector as a whole to sink into the wearer's abdomen. As a result, smooth disengagement is frequently hindered due to the fact that the pressure conveyed to the plate spring from the operating member is not sufficient to elastically deform the plate spring to the point necessary for releasing the engagement between the inserts or the like and the plate spring elastically engaged therewith.

Because of this, the disengagement sometimes has to be achieved by, for example, inserting one or more fingers between the wearer's abdomen and the case of the belt connector and squeezing the case from both sides.

Moreover, since the distal end of the operating member used to depress the pivoted plate spring swings along an arc centered on the pivot point between the case and the plate spring, the operating member cannot be pushed straight toward the rear of the case. This makes it hard to press the operating member in smoothly.

OBJECT OF THE INVENTION

The present invention was accomplished in light of these circumstances and has as its object to provide a buckle for joining together three belts and which enables disengagement of a pair male members from a female member by a depressing operation that can be conducted easily and smoothly.

SUMMARY OF THE INVENTION

The invention achieves this object by providing a buckle comprising:

a female member having a main body provided at opposite ends with sockets, a belt retainer adapted for fastening one end of a third belt thereto provided on one side of the main body so as to extend between the sockets, an engaging member housed in the main body of the female member and formed with engaging end portions having engaging claws facing the sockets and projecting toward the belt retainer and elastic pieces whose tips contact an inner wall of the main body on the side thereof opposite from the belt retainer for the third belt, and a window formed in the main body on the side of the belt retainer for communicating the interior of the main body with the exterior and allowing a portion of the engaging member to project downward therefrom under a force constantly applied to the engaging member, in the direction of the belt retainer of the female member, by the elastic pieces, and a pair of male members adapted for fastening one end of each one of first and second belts thereto and insertable into the sockets of the main body to be retained thereby, each male member having an insert formed with an engaging claw which projects toward the inner wall of the main body and engages with the associated engaging claw of the engaging member when the male member is inserted into the associated socket of the main body, the engagement between the engaging claws of the engaging member of the female member and the engaging claws of the male members being releasable by pressing the portion of the engaging member projecting from the window toward the inner wall of the female member against the force of the elastic pieces.

In the buckle according to this invention, the engaging member has engaging claws facing the sockets and projecting toward the belt retainer and elastic pieces which urge the engaging member toward the belt retainer, and the window is provided for allowing a portion of the engaging member to project downward. Each of the male members has an insert formed with an engaging claw which projects toward the inner wall of the main body on the side thereof opposite from the belt retainer and engages with the associated engaging claw of the engaging member when the male member is inserted into the associated socket. As a result of this configuration, the engagement between the engaging claws of the female member and the engaging claws of the male members can be easily released by pressing the portion of the engaging member projecting from the window upward, that is, toward the inner wall.

BRIEF DESCRIPTION OF THE DRAWINGS

Various other object, features, and attendant advantages of the present invention will be more fully appreciated from the following detailed description when considered in connection with the accompanying drawings in which like reference characters designate like or corresponding parts throughout the several views, and wherein.

DESCRIPTION OF THE PREFERRED EMBODIMENT

A typical embodiment of the buckle B of the invention will be explained with reference to FIGS. 1 to 26.

Figure 2:
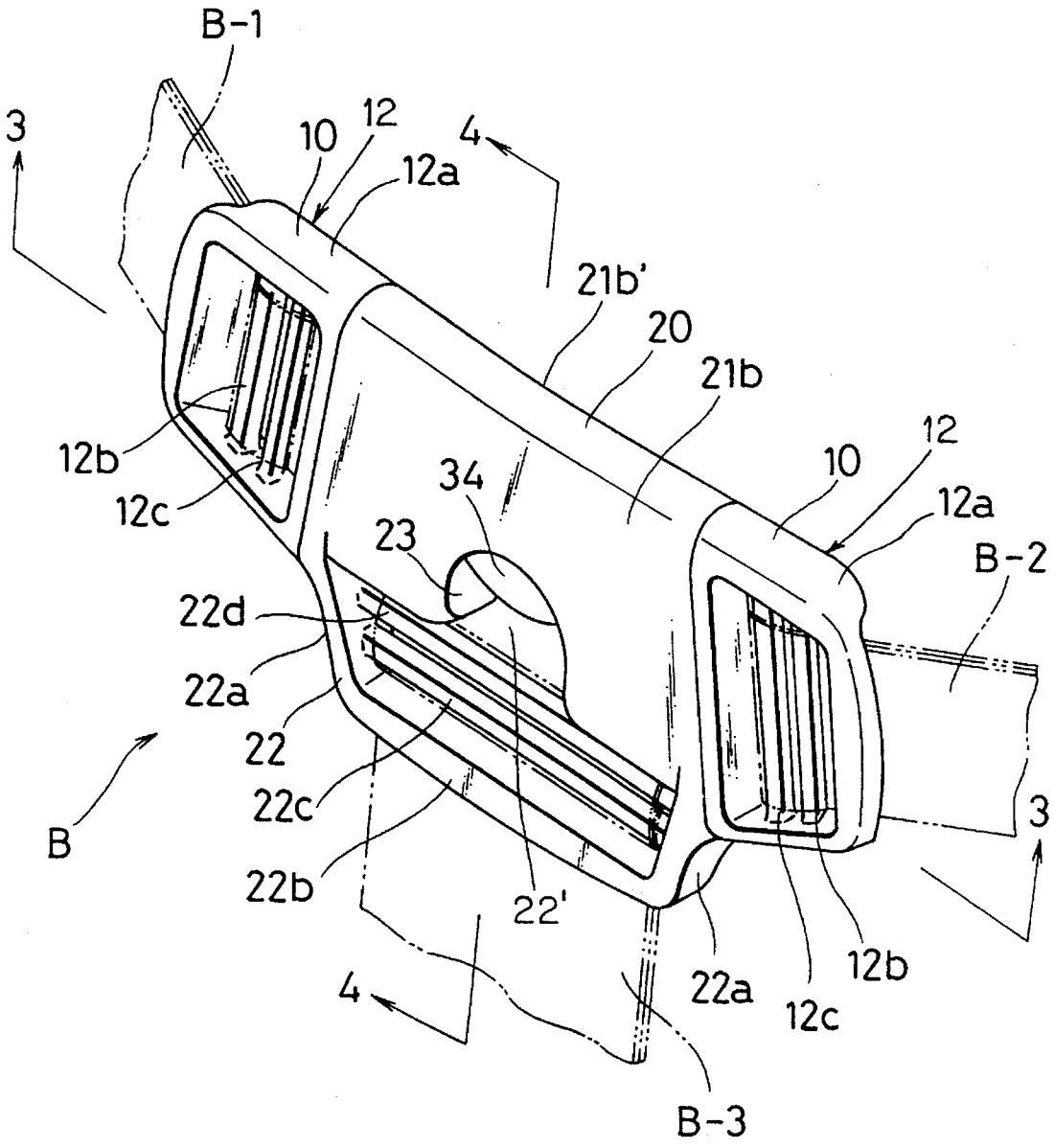
FIG. 2 is a perspective view of the buckle of FIG. 1 showing the male members engaged with the female member.

As shown in FIG. 2, the buckle B according to the illustrated embodiment comprises a female member 20 having a belt retainer 22 to which a third belt B-3 is fastened, and a pair of male members 10 having belt retainers 12 to which first and second belts B-1, B-2 are fastened. For joining the first, second and third belts B-1, B-2 and B-3 with the buckle B, the male members 10 are inserted into the female member 20.

Figure 1:
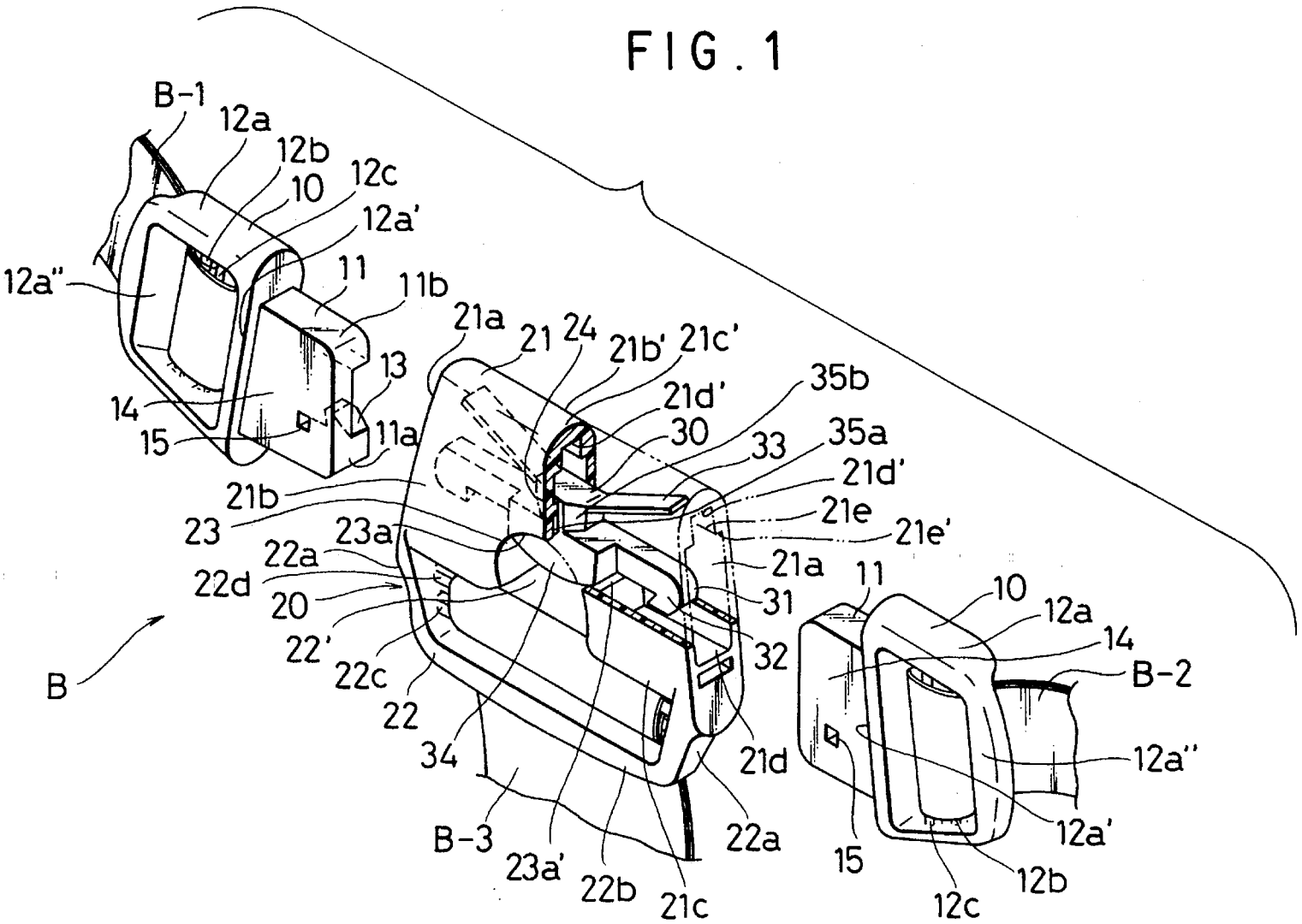
FIG. 1 is a perspective view, partially broken away, of an embodiment of the buckle according to the invention and showing its male members separated from its female member.

One particular feature of the buckle B of this embodiment is that, as shown in FIG. 1, an operating projection 34 is biased by elastic means so as to protrude through a window 23*a* into a finger hole 22' in the belt retainer 22 for the third belt B-3 of the female member 20, and the male members 10 inserted into the female member 20 can be disengaged therefrom by pressing the operating projection 34 toward the opposite side of the female member 20 from that side of the female member provided with the belt retainer 22. Thus the disengagement can be achieved easily and reliably by inserting a finger into the finger hole 22' and pressing the operating projection 34 in the direction away from the belt retainer 22.

Moreover, since the pressure applied to the operating projection 34 for disengaging the male members 10 does not force the buckle B onto the abdomen of the wearer secured by the first, second and third belts B-1, B-2, B-3 joined by the buckle B, the wearer does not experience any uncomfortable pressure.

Figure 5:
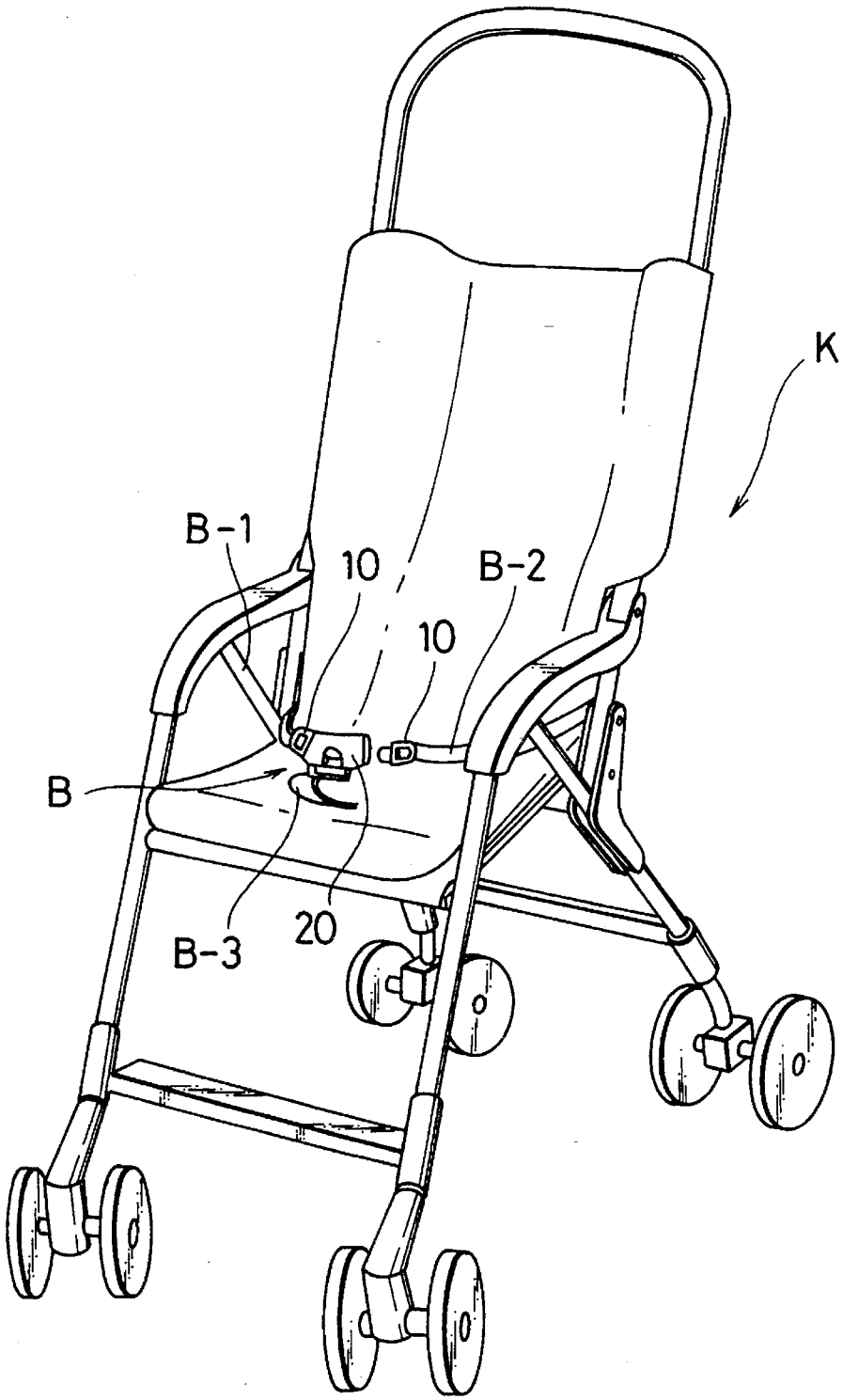
FIG. 5 is a perspective view showing a buckle according to the invention in use upon a stroller.

The buckle B according to this embodiment is therefore useful for joining the belts of a belt-type vehicle passenger restraining device and various other three-point seat belt restrainers, for joining, as shown in FIG. 5, the pair of waist belts B-1, B-2 and the crotch belt B-3 constituting a seat belt restrainer of a stroller, and for various three-point seat belts for restraining a baby or small child in a vehicle baby seat or a baby chair.

The female member 20 of the buckle B according to this embodiment will now described in detail.

The female member 20 comprises a main body 21 having the shape of a flattened cylinder and formed at opposite ends with sockets 21a for receiving and retaining the pair of male members 10, which will be described later, and the belt retainer 22 formed on one side of the main body 21 so as to extend between the sockets 21*a* for retaining the third belt B-3.

More specifically, the main body 21 has broad front and rear surfaces 21*b*, 21*b*' lying substantially parallel to one another, and the third belt B-3 retainer 22 is formed by a pair of support arms 22*a* projecting downward from the opposite ends of the bottom side 21*c* of the main body 21, a connecting rod 22*b* bridging the distal ends of the support arms 22*a*, and upper and lower third belt B-3 retaining rods 22*d*, 22*c* bridging the middle portions of the support arms 22*a*.

The side of the main body 21 on which the belt retainer 22 is provided is formed at approximately the middle thereof with an indentation 23 extending toward the opposite side 21*c*' the top side of the main body 21 opposite the bottom side 21*c* having the belt retainer 22 so as to extend to about the middle of the width of the main body 21. The indentation 23 is rounded at the inner end. A window 23*a* providing communication between the interior and exterior of the main body 21 is formed at the rounded inner end of the indentation 23 so as to extend in the thickness direction of the main body 21.

The main body 21 houses a thin rod-like engaging member 30 having the configuration shown in FIGS. 22 to 26.

Figure 3:
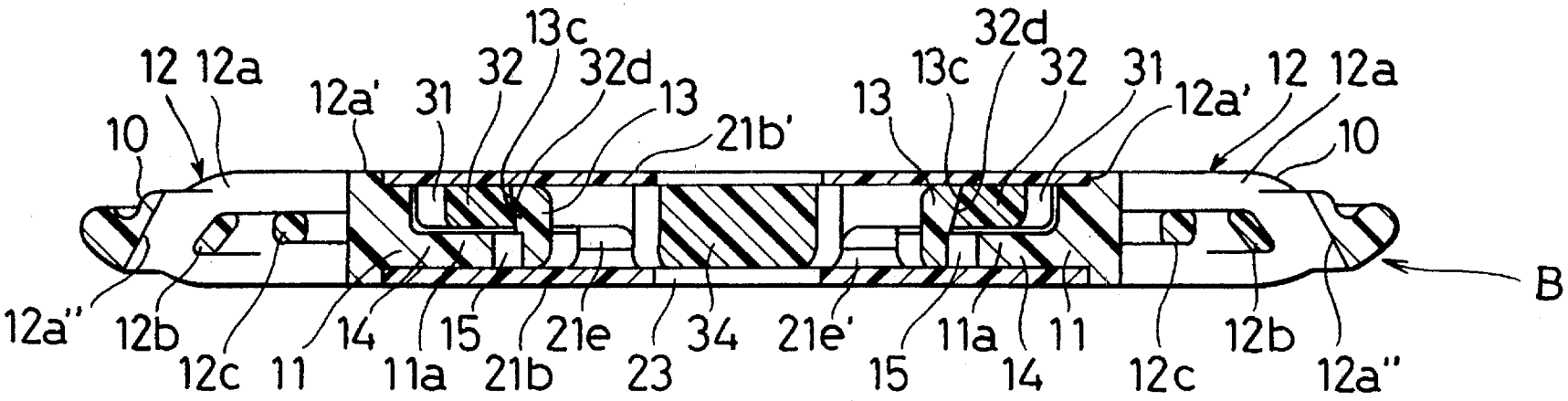
FIG. 3 is a sectional view taken along line 3—3 in FIG. 2

As shown in FIGS. 1 and 3, the engaging member 30 is accommodated in the main body 21 with its engaging end portions 31 facing the sockets 21*a*.

The engaging member 30 is formed at its approximate center as considered in the lengthwise direction with a mesa-like protuberance 35 rising toward the inner wall 21*d*' of the side 21*c*' of the main body 21 not formed with the belt retainer 22. Left and right elastic pieces 33 are provided so as to extend diagonally from the sides of the protuberance 35 facing the sockets 21*a* of the main body 21 to a distance enabling their tips to make contact with the inner wall 21*d*' of the side 21*c*'. The pair of elastic pieces 33 is housed in the main body 21 so as to constantly urge the engaging member 30 toward the side 21*c* of the main body 21 formed with the belt retainer 22.

The engaging member 30 is further provided at its approximate center in the lengthwise direction with the operating projection 34, which is formed as a rounded portion swelling out from the engaging member 30 in the direction of the bottom side 21*c* of the main body 21 formed with the belt retainer 22.

Since the operating projection 34 is provided so as to be located at the window 23*a* formed at the inner end of the indentation 23 of the main body 21, the force of the elastic pieces 33 causes the engaging member 30 to keep the operating projection 34 constantly pushed outward through the window 23*a* formed in the thickness direction of the main body 21 and projected into the finger hole 22' of the belt retainer 22, while maintaining the opposite end faces of the operating projection 34 in contact with the opposite edges 23*a*' of the window 23*a*.

Figure 4:
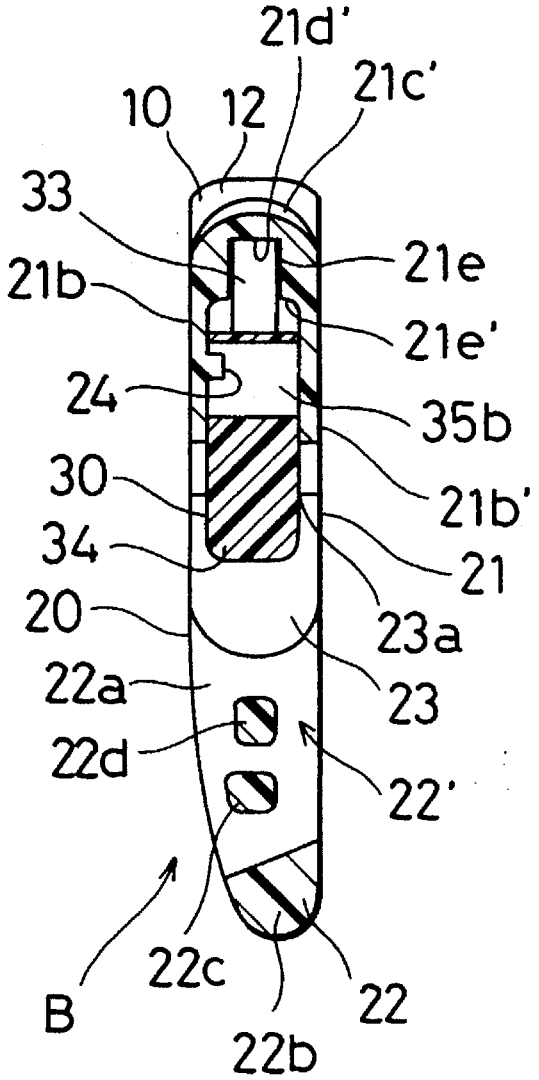
FIG. 4 a sectional view taken along line 4—4 in FIG. 2.

The mesa-like protuberance 35 at the proximal ends of the pair of elastic pieces 33 of the engaging member 30 is formed with an elongate hole 35*a* extending in the vertical direction of the main body 21 and passing through the engaging member 30 from the side thereof facing the front surface 21*b* of the main body 21 to the side facing the rear surface 21*b*' of the main body 21. A projection 24 of triangular shape when viewed in lateral section is formed on the inner surface of the side plate of the main body 21 located immediately above the indentation 23 on the side of the front surface 21*b*. Since, as shown in FIGS. 3 and 4, the thickness of the middle portion of the engaging member 30 is made approximately the same as the width of the void at the center portion of the female member 20, the engaging member 30 receives the projection 24 in the hole 35*a*. The engaging member 30 can therefore be incorporated within the main body 21 so as to be vertically movable while maintaining a snug fit therein.

Figure 15:
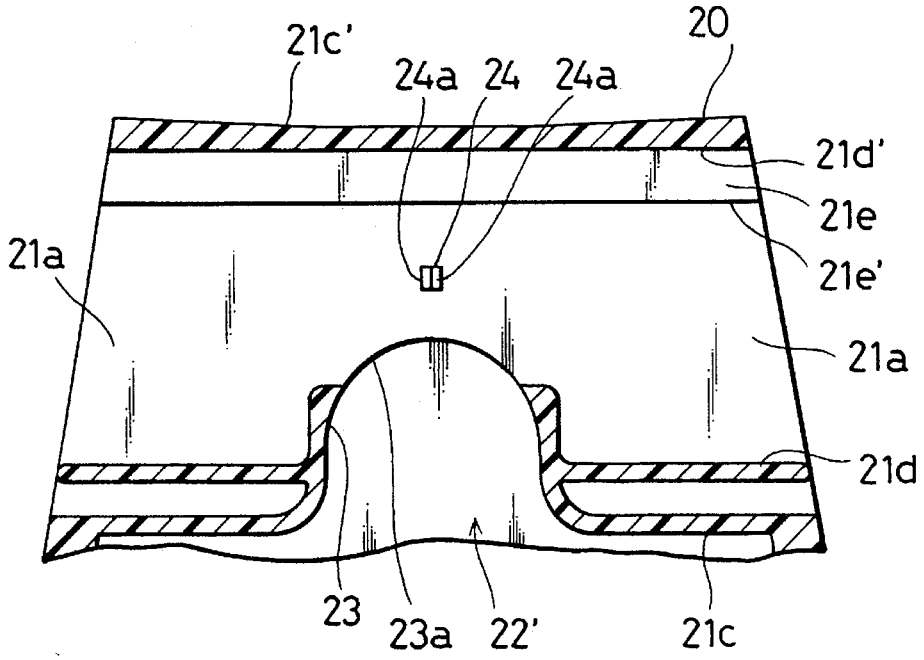
FIG. 15 is a sectional view taken along line 15—15 of FIG. 12.
Figure 16:
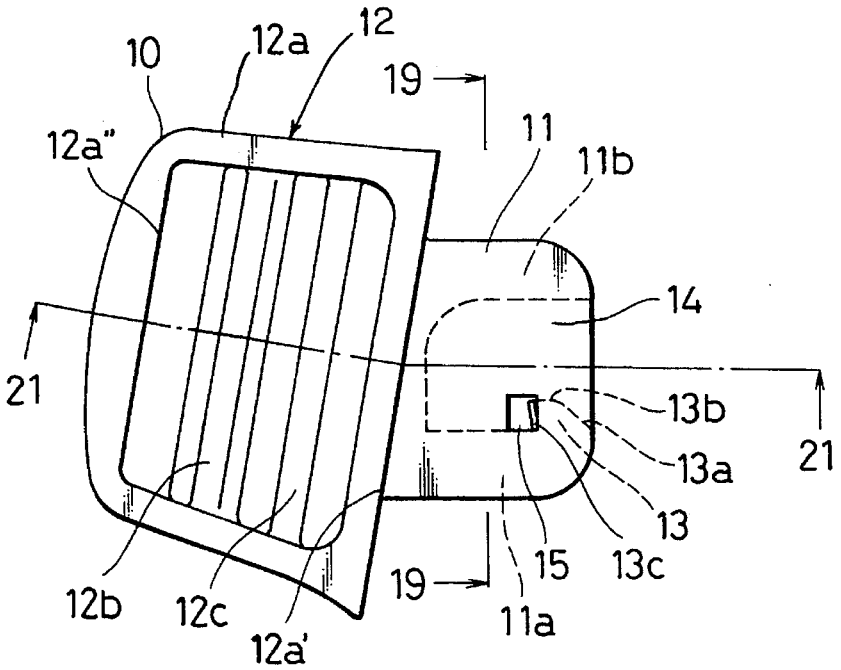
FIG. 16 is a front view of a male member of FIG. 1.
Figure 17:
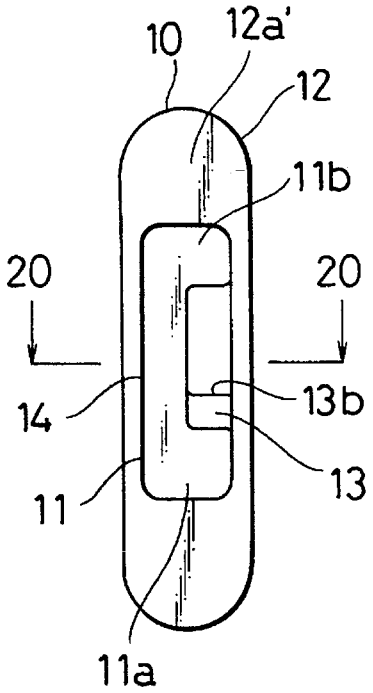
FIG. 17 is a side view of the male member of FIG. 16.
Figure 18:
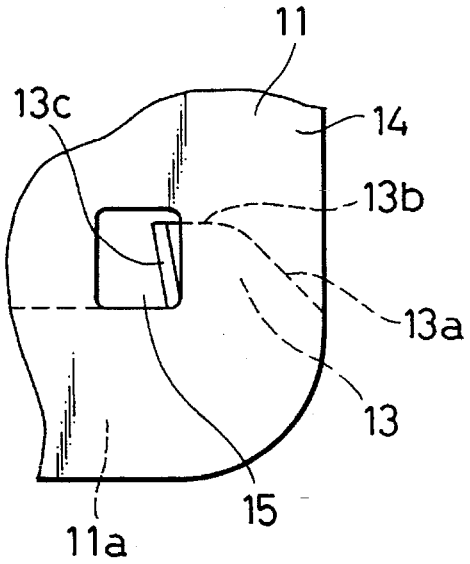
FIG. 18 is an enlarged view of an essential portion of the male member of FIG. 16.
Figure 19:
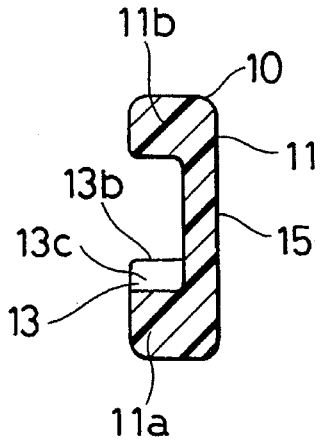
FIG. 19 is a sectional view taken along line 19—19 in FIG. 16.
Figure 20:
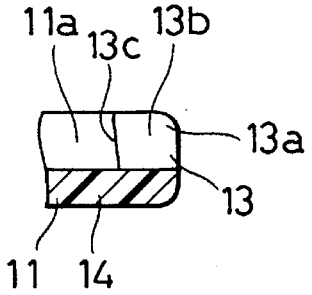
FIG. 20 is a sectional view taken along line 20—20 in FIG. 17.
Figure 21:
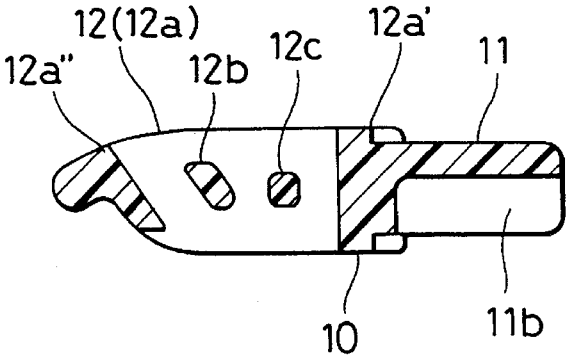
FIG. 21 is a sectional view taken along line 21—21 in FIG. 16.
Figure 22:
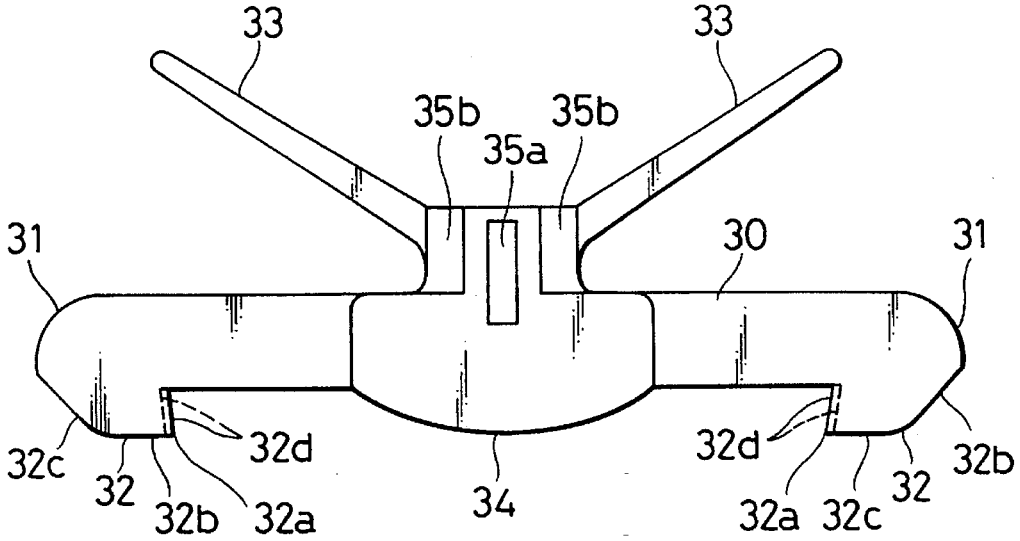
FIG. 22 is a front view of an engaging member of the female member.
Figure 23:
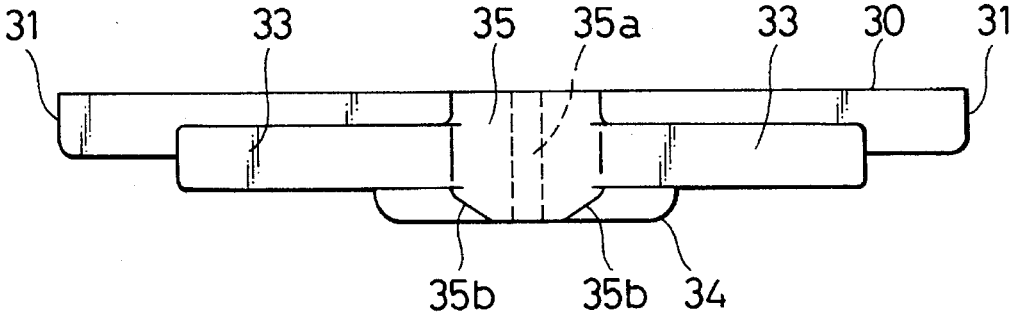
FIG. 23 is a plan view of the engaging member of FIG. 22.
Figure 24:
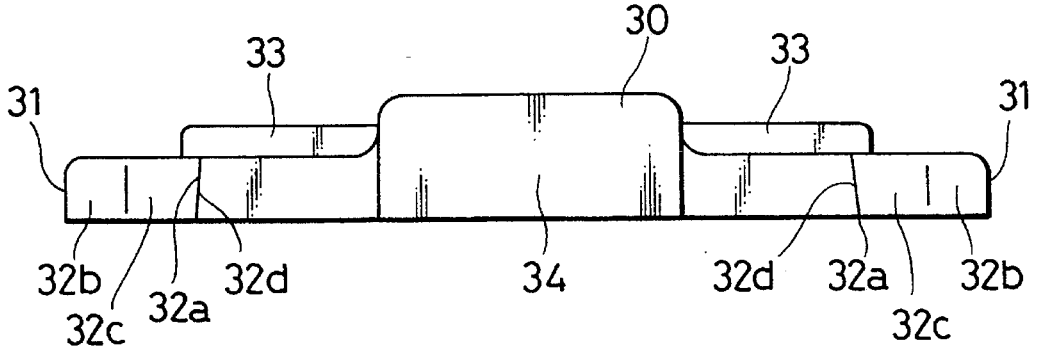
FIG. 24 is a bottom view of the engaging member of FIG. 22.
Figure 25:
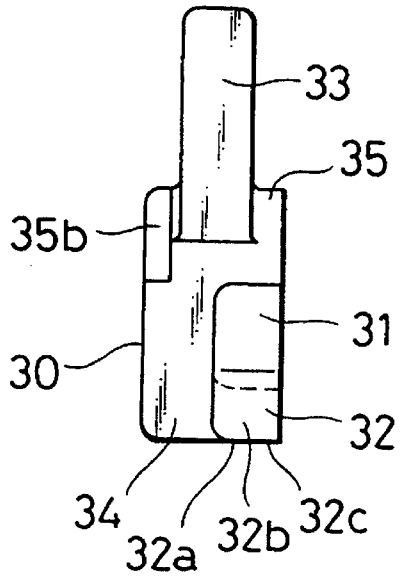
FIG. 25 is a side view of the engaging member of FIG. 22.
Figure 26:
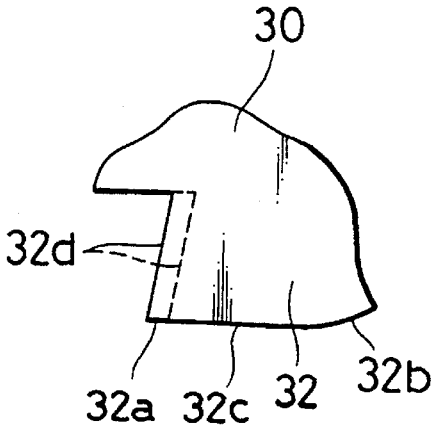
FIG. 26 is an enlarged view of an essential portion of the engaging member of FIG. 22.

The left and right sides of the mesa-like protuberance 35 between which the hole 35*a* is located are formed at their ends facing the front surface 21*b* of the main body 21 with inclined surfaces 35*b* tapering to greater heights or thicknesses toward the edges of the hole 35*a*. On the other hand, as shown in FIG. 15, the projection 24 is provided with inclined surfaces 24*a* on its sides facing the sockets 21*a*. When the engaging member 30 is inserted into the main body 21 at the time of assembling the female member 20, therefore, the insertion of the projection 24 into the hole 35*a* can be smoothly achieved by inserting one or the other of the engaging end portions 31 of the engaging member 30 into the appropriate one of the sockets 21*a* of the main body 21.

The width in the front to back direction of the void within the main body 21 is made narrower at a region 21*e* located near and extending along the full length of the side 21*c*'. The void width at this narrowed region 21*e* is made approximately equal to the width of the elastic pieces 33 of the engaging member 30, and the engaging member 30 is housed in the main body 21 with the tips of its elastic pieces 33 in contact with and guided by the walls of the narrowed region 21*e*.

The engaging end portions 31 of the engaging member 30 are formed with hook-like engaging claws 32 having tips 32*a* that project toward the belt retainer 22 of the main body 21.

Figure 6:
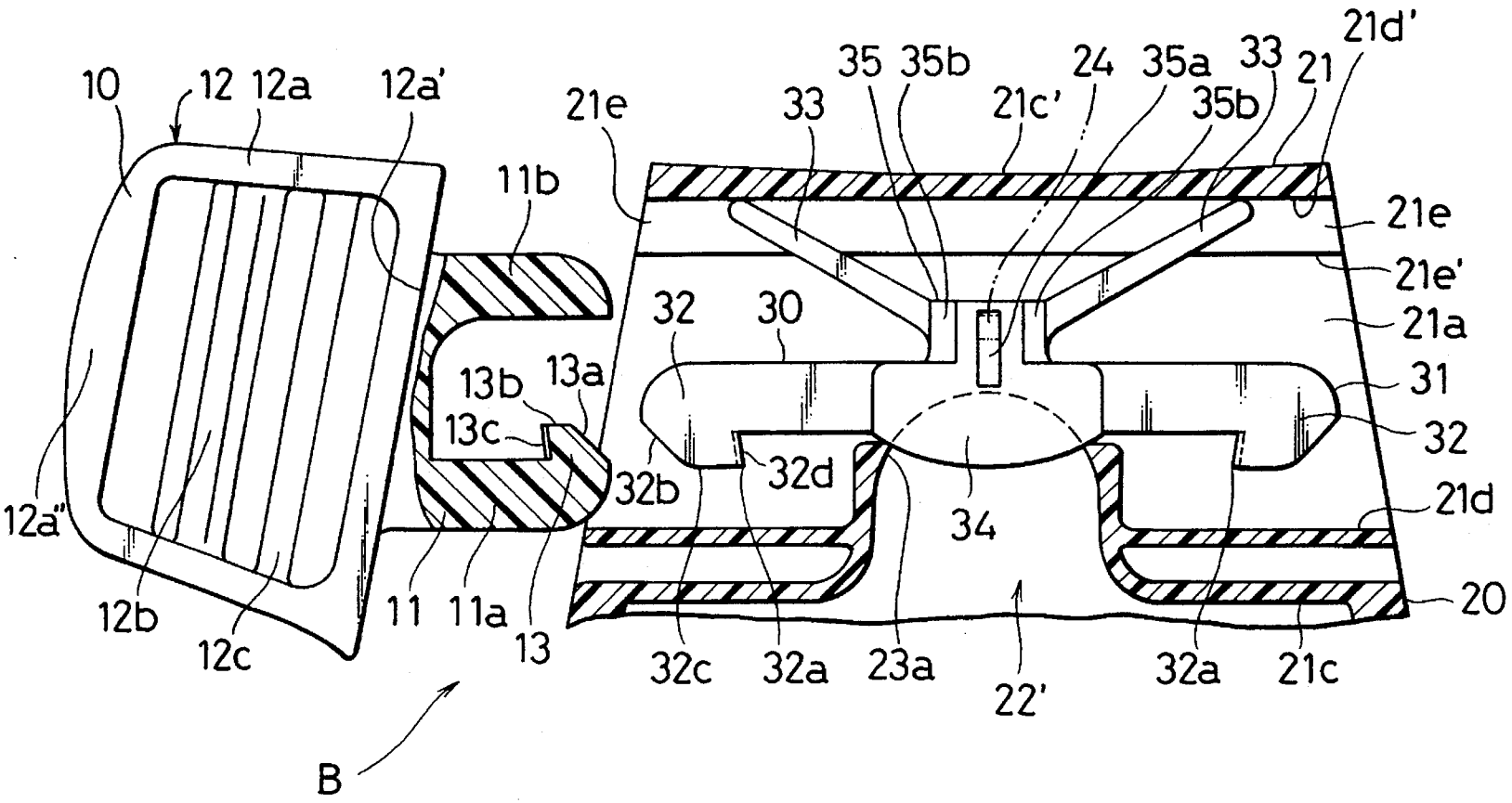
FIG. 6 is a sectional view of an essential portion of a buckle according to the invention showing the insert of a male member positioned opposite a socket of a female member.

More specifically, as shown for example in FIG. 6, the engaging claw 32 formed at each engaging end portion 31 of the engaging member 30 has an inclined surface 32*b* which slants inward and downward away from the socket 21*a* of the main body 21 toward an inner wall 21*d* of the side 21*c*, a lateral surface 32*c* continuing from the inclined surface 32*b* and extending substantially parallel to the surface of the inner wall 21*d*, and an engaging surface 32*d* continuing from the lateral surface 32*c* and facing the operating projection 34 of the engaging member 30.

The engaging member 30 of the female member 20 configured as described in the foregoing is preferably integrally formed mainly of soft or semi-hard plastic or other such synthetic resin so as to impart the elastic pieces 33 with the required elastic deformation property.

The male members 10 of the buckle B of this embodiment will now be explained.

Each of the male members 10 of the buckle B according to this embodiment comprises an insert 11 for insertion into a socket 21*a* of the main body 21 of the female member 20 and a belt retainer 12 to which the first belt B-1 or the second belt B-2 is fastened. The belt retainer 12 comprises of an annular frame 12*a* of a generally square shape provided on one side 12*a*' with the insert 11, and belt B-1 or B-2 retaining rods 12*b*, 12*c* which bridge the sides of the annular frame 12*a* extending in parallel from the opposite ends of the first side member 12*a*' and which lie substantially parallel to the first side member 12*a*' as spaced from each other.

As best shown in FIG. 1, the male member 10 to be inserted into the socket 21*a* on one side of the main body 21 and the male member 10 to be inserted into the other socket 21*a* are laterally symmetrical. FIGS. 16 to 21 therefore show only the male member 10 to be inserted into the socket 21*a* of the main body 21 on the left side as viewed from the side of front surface 21*b*, and the description in this specification is limited to the male member 10 shown in these figures. No description is given regarding the male member 10 to be inserted into the socket 21*a* on the right side of the main body 21 however it is to be understood that the structure of such right-side male member 10 is similar to that described in connection with the left-side male member 10 in view of the noted symmetry of such components.

The insert 11 of the male member 10 is formed with a pair of projecting portions 11*a*, 11*b* which embrace the engaging end portion 31 of the engaging member 30 of the female member 20 from opposite sides when the insert 11 is inserted into the socket 21*a* of the female member 20. The projecting portion 11*a*, which is adapted to make contact with the lower side of the engaging member 30, is provided at its distal end with an engaging claw 13. The tip of the engaging claw 13 is directed toward the inner wall 21*d*' on serving the side 21*c* ' of the main body 21 serves to retain the male member 10 in the female member 20 and, at the time of insertion, engages with the engaging claw 32 provided on the engaging end portion 31 of the engaging member 30.

More specifically, as shown for example in FIG. 6, the engaging claw 13 provided at the distal end portion of the projecting portion 11*a* is formed with an inclined surface 13*a* which slants upward from the extremity of the distal end portion toward the first side member 12*a*' of the belt retainer 12, a lateral surface 13*b* continuing from the inclined surface 13*a*, and an engaging surface 13*c* continuing from the lateral surface 13*b* and facing the first side member 12*a*' of the belt retainer 12.

The male member 10 is further provided between the projecting portions 11*a*, 11*b* with a plate member 14 which contacts the inner wall of the female member 20 on the side of the front surface 21*b* when the male member 10 is inserted into the female member 20. The plate member 14 is formed with an approximately square window 15 through means of which the engaging claw 13 can be seen.

The steps in the engagement and disengagement of the male members 10 and the female member 20 and the method in which the buckle B is used will now be described with reference to FIG. 6 to 10.

As shown in FIGS. 1 and 2, for example, the first belt B-1 or the second belt B-2 can be fastened to the annular frame 12*a* of the male member 10 by inserting the end of the belt between the belt retaining rod 12*b* and a second side member 12*a*" that is, the side of the annular frame 12*a* opposite the first side member 12*a*', from the side of the male member 10 not formed with the plate member 14, wrapping the belt over the belt retaining rod 12*c*, and then passing it back to the upper side of the belt retaining rod 12*b* and to the outside between the belt retaining rod 12*b* and the second side member 12*a*".

The third belt B-3 can be fastened to the belt retainer 22 of the female member 20 by inserting the end of the belt between the connecting rod 22*b* and the lower retaining rod 22*c* from the side of the rear surface 21*b*' of the female member 20, wrapping the belt over the upper retaining rod 22*d*, and then passing the belt back to the upper side of the lower retaining rod 22*c* and to the outside between the retaining rod 22*c* and the connecting rod 22*b*.

After the first belt B-1 and the second belt B-2 have been fastened to the male members 10, the inserts 11 of the male members 10 are inserted into the sockets 21*a* of the female member 20 to which the third belt B-3 is attached. As shown in FIG. 6, the insertion is conducted with the plate member 14, provided between the projecting portions 11*a*, 11*b* of the insert 11 of the male member 10, facing toward the front surface 21*b* of the female member 20. Since, as shown in FIG. 6, the distance between the outer edges of the projecting portions 11*a*, 11*b* of the insert 11 and the distance between the inner wall 21*d* on the side 21*c* of the main body 21 and the step surface 21*e*' below the narrowed region 21*e* the side 21*c*' are approximately the same, the insertion can be made straight into the main body 21.

If the user should attempt to make the insertion with the male member 10 turned upside down, that is, with the plate member 14, provided between the projecting portions 11*a*, 11*b*, oriented to make contact with the rear surface 21*b*' of the main body 21, the leading end of the plate member 14 will, as shown in FIG. 3, strike the engaging end portion 31 of the engaging member 30, making further insertion impossible. Thus the male member 10 cannot be inserted in the main body 21 in the wrong orientation.

Figure 7:
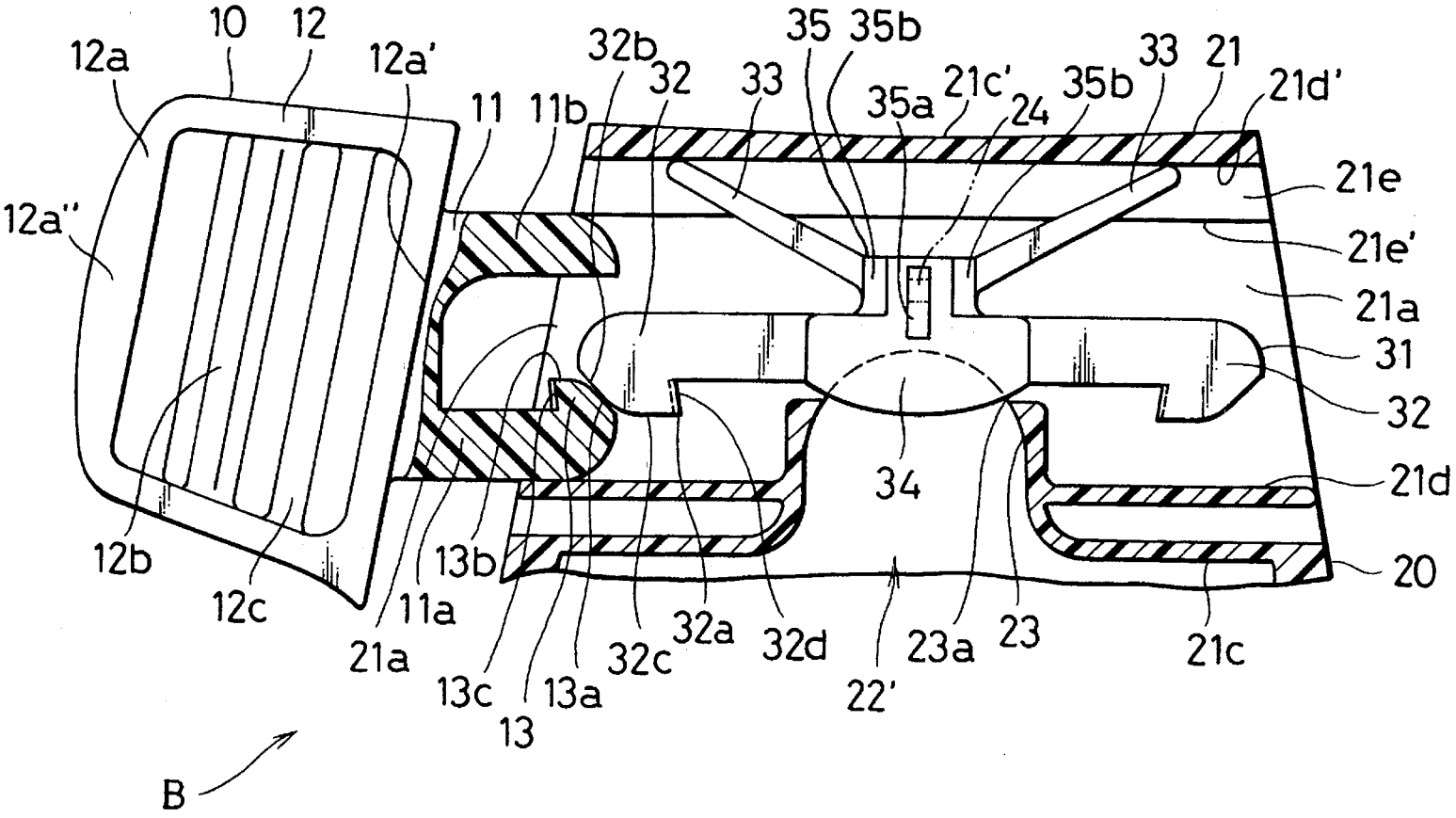
FIG. 7 is a sectional view of the essential portion of FIG. 6 showing the engaging claw of the male member insert in contact with the engaging claw of the female member socket.

When the insert 11 of the male member 10 is inserted into the main body 21 in the proper manner as shown in FIG. 7, the leading end of the insert 11 strikes the engaging end portion 31 of the engaging member 30. Moreover, since the engaging claw 13 provided at the tip of the projecting portion 11*a* of the insert 11 is formed with the inclined surface 13*a* and the engaging claw 32 of the engaging end portion 31 is formed with the inclined surface 32*b*, the engaging member 30 is gradually and smoothly raised toward the side 21*c*' of the main body 21 against the biasing force of the elastic pieces 33 of the engaging member 30 as the inclined surfaces 13*a*, 32*b* slide along each other.

Figure 8:
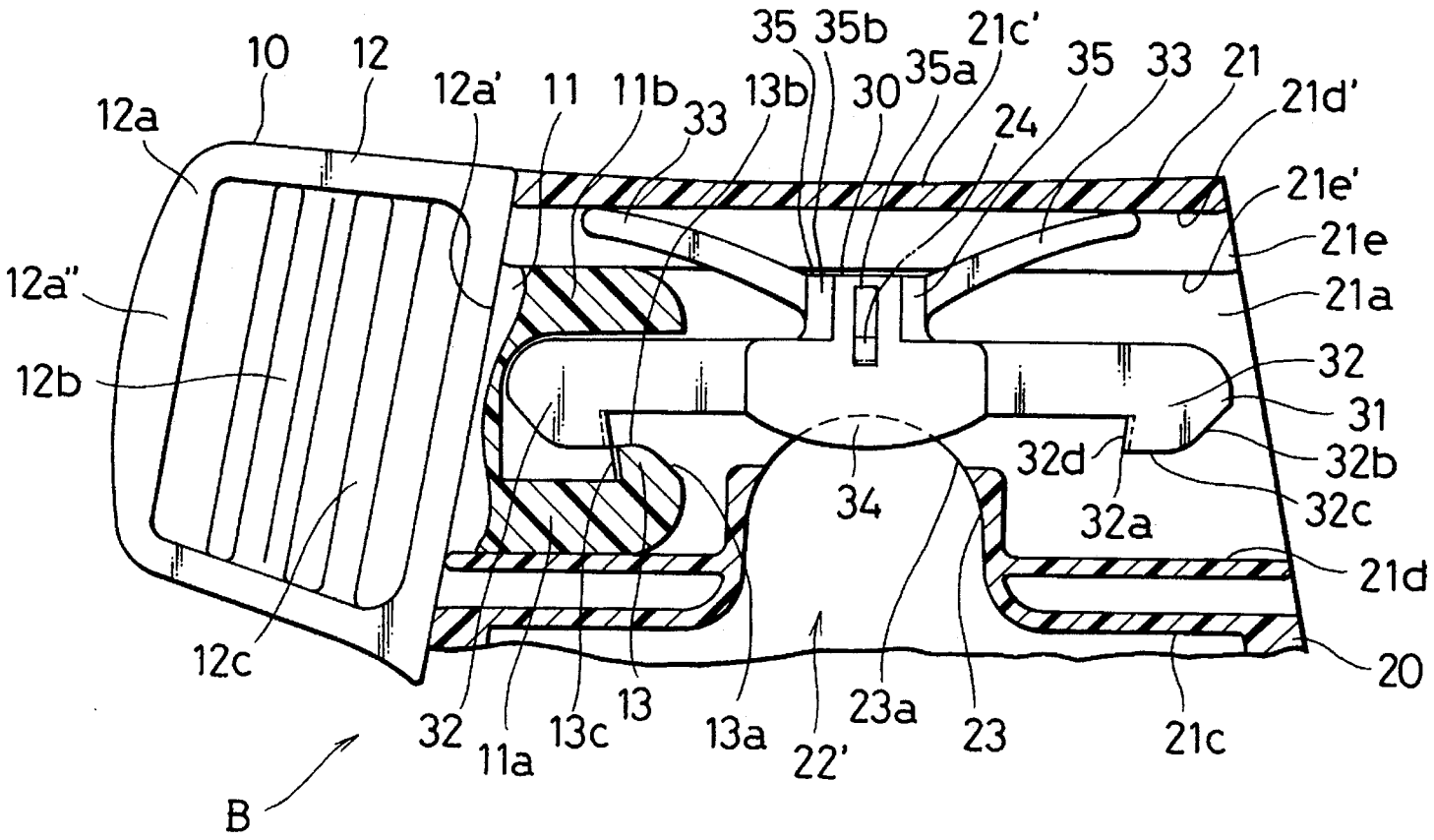
FIG. 8 is a sectional view of the essential portion of FIG. 7 showing the engaging claw of the male member having pushed up the engaging claw of the female member.
Figure 9:
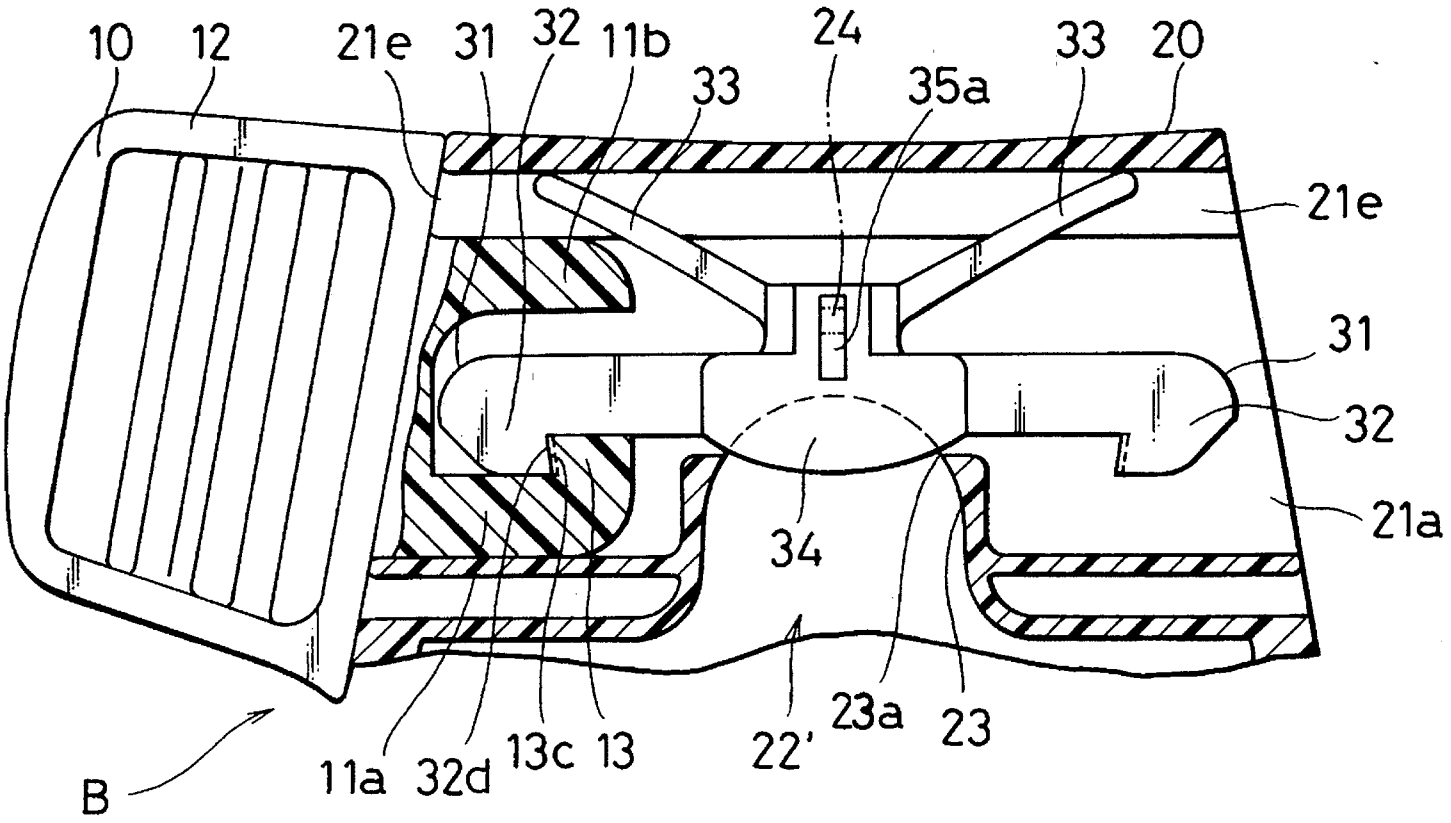
FIG. 9 is a sectional view of the essential portion of FIG. 7 showing the two engaging claws in engagement.

With further insertion of the insert 11 of the male member 10 into the main body 21 as shown in FIG. 8, the edge at the intersection between the lateral surface 13*b* and the engaging surface 13*c* of the engaging claw 13 of the male member 10 rides over the tip 32*a* where the lateral surface 32*c* of the engaging claw 32 and the engaging surface 32*d* of the engaging claw 32 intersect, at which point, as shown in FIG. 9, the biasing force of the elastic pieces 33 presses the engaging member 30 back down toward the side 21*c* of the main body 21. In this depressed condition, the engaging surface 13*c* of the engaging claw 13 of the male member 10 and the engaging surface 32*d* of the engaging claw 32 of the engaging member 30 come into contact, thereby engaging the engaging claws 13, 32 and making it impossible to pull the insert 11 of the male member 10 out of the main body 21.

Since the male members 10 are inserted into both sides of the female member 20 and retained thereby, the first and second belts B-1, B-2 fastened to the male members 10, and the third belt B-3 fastened to the female member 20, are joined together.

Figure 10:
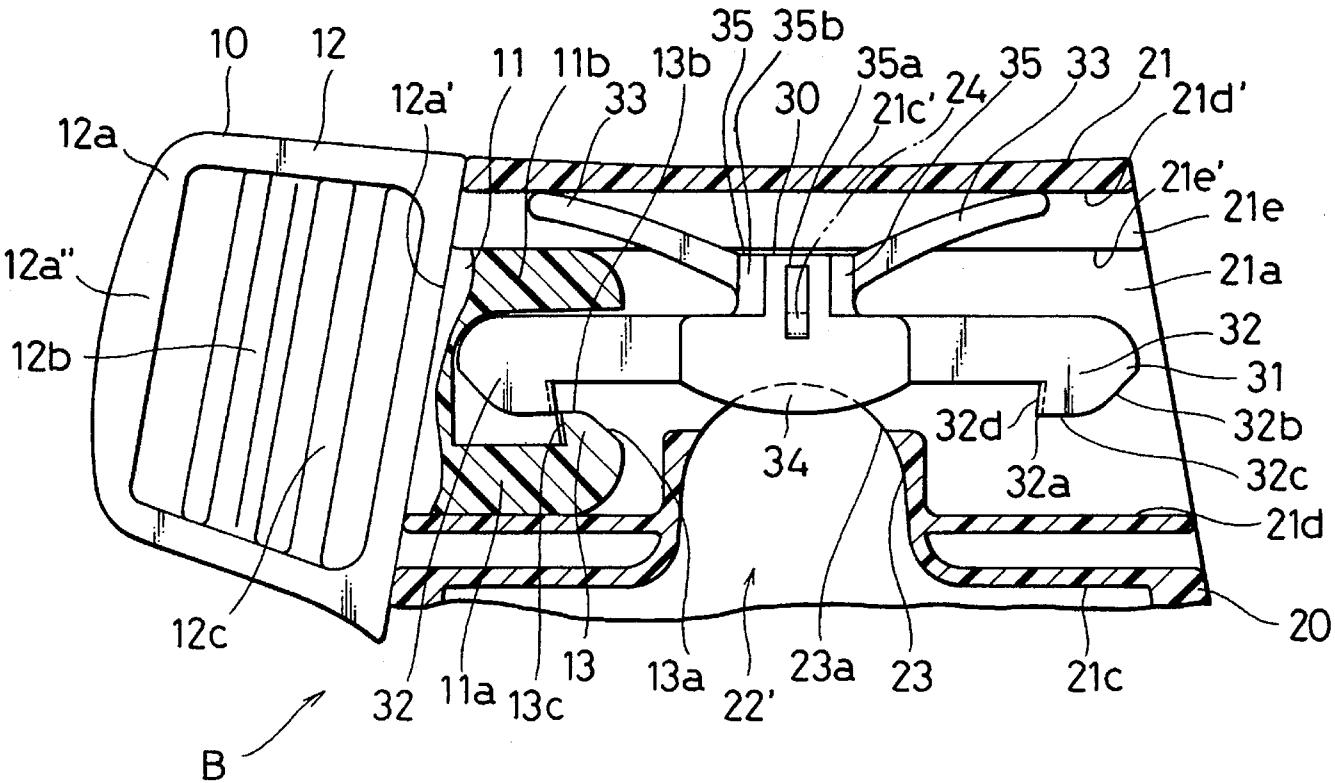
FIG. 10 is a sectional view of the essential portion of FIG. 9 showing the once engaged engaging claws in the process of disengaging.
Figure 11:
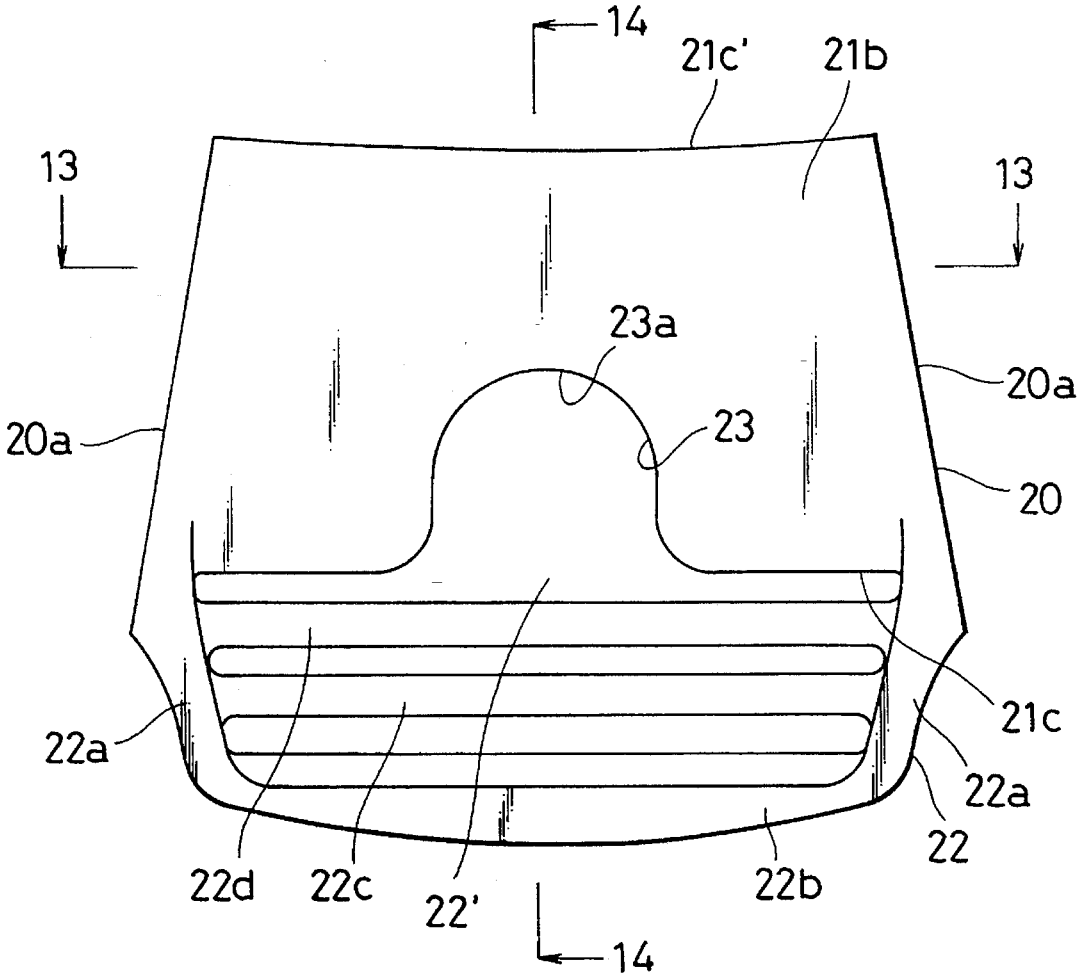
FIG. 11 is a front view of the female member of the buckle of FIG. 1.
Figure 12:
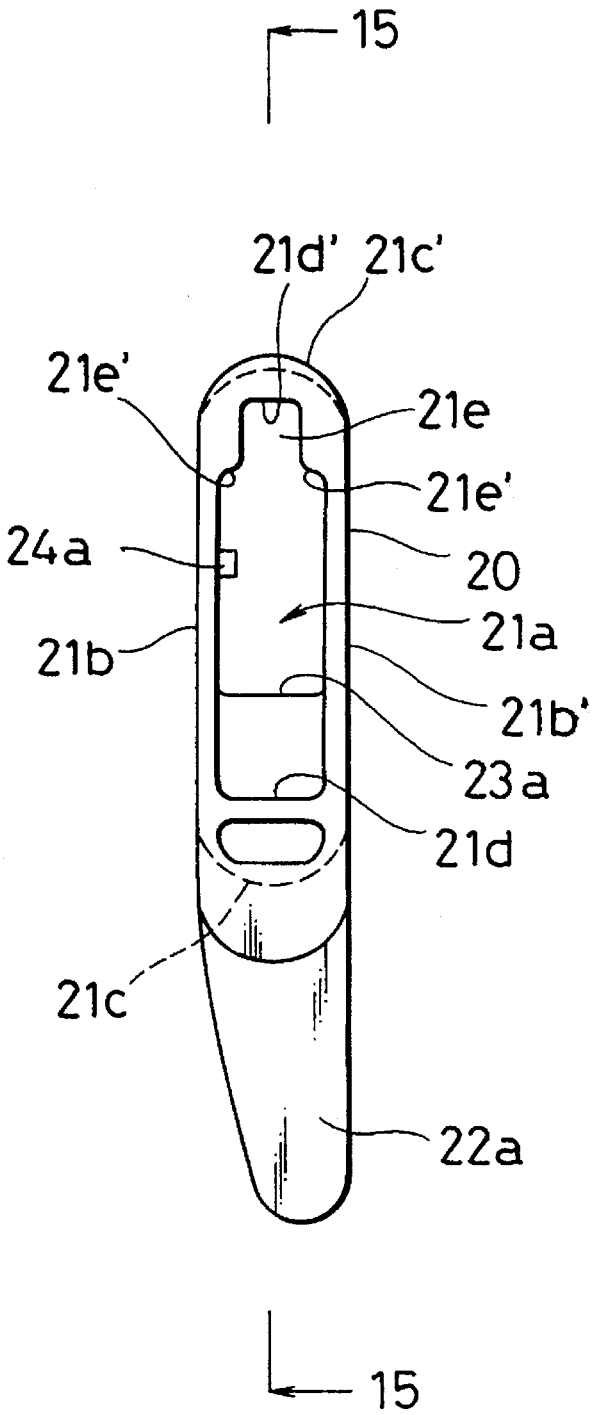
FIG. 12 is a side view of the female member of FIG. 11.
Figure 13:
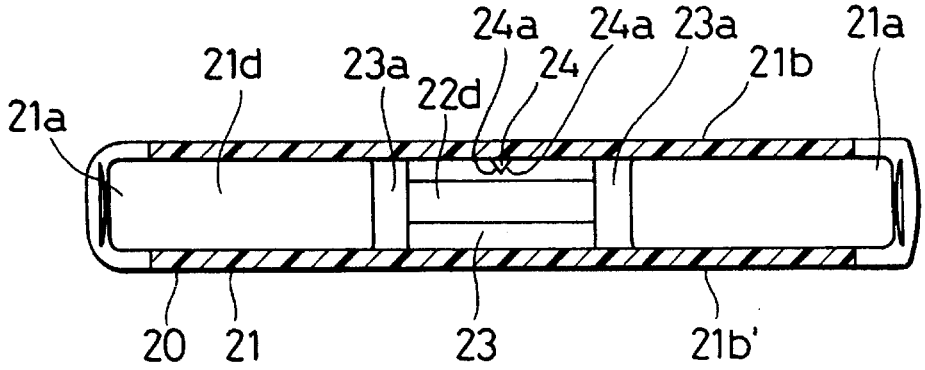
FIG. 13 is a sectional view taken along line 13—13 in FIG. 11.
Figure 14:
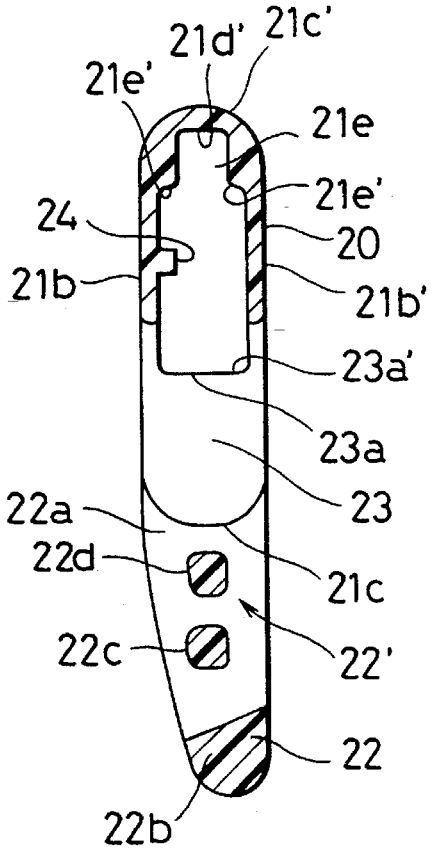
FIG. 14 is a sectional view taken along line 14—14 in FIG. 11

As can be seen in FIG. 9, the operating projection 34 of the engaging member 30 is projects outwardly through the window 23*a* into the finger hole 22' of the belt retainer 22 formed in the indentation 23 of the main body 21 when the male members 10 are inserted in and retained by the female member 20. When it is desired to release the engagement defined between the male and female, it suffices to press the operating projection 34 into the main body 21 with a finger so as raise the engaging member 30 toward the side 21*c*' against the biasing force of the elastic pieces 33. As shown in FIG. 10, in each of the male members 10 this action releases the engagement between the engaging claw 13 of the male member 10 and the engaging claw 32 of the engaging member 30 by bringing their engaging surfaces 13*c*, 32*d* out of contact with each other. Thus the inserts 11 of the male members 10 can be extracted from the main body 21.

As a result, the aforenoted joined state of the first and second belts B-1 fastened to the male members 10 and the third belt B-3 fastened to the female member 20 can be released.

A particular feature of this embodiment is that the engaging surface 32*d* of each engaging claw 32 of the engaging member 30 housed in the main body 21 is formed as a surface inclined so as to gradually approach the engaging end portion 31 of the engaging member 30 from the side of the front surface 21*b* toward the rear surface 21*b*' of the main body 21, and the engaging surface 13*c* of the engaging claw 13 of the male member 10 is formed as a surface inclined so as to gradually approach the tip of the projecting portion 11*a* formed on the engaging claw 13 as it approaches the window 15 formed in the plate member 14. Thus in the engaged state of the engaging claws 13, 32 shown in FIG. 9, the engaging surfaces 13*c*, 32*d* make intimate contact that ensures a highly reliable state of engagement.

Moreover, since the plate member 14 of the male member 10 is provided with the window 15, the engaging surface 13*c* of the engaging claw 13 can be easily formed with the aforenoted inclination through the window 15 at the time the male member 10 is integrally molded of a plastic material.

In the buckle B according to this invention, the engaging member 30, housed in the female member 20 and provided with the engaging claws 32 engageable with the engaging claws 13 provided on the inserts 11 of the male members 10, is constantly urged toward the belt retainer 22 side by the elastic pieces 33, the engaging claws 13 project toward the inner wall 21*d*' located opposite and facing the belt retainer 22 of the main body 21, the engaging claws 32 project toward the belt retainer 22, and a part 34 of the engaging member 30 projects downward through the window 23*a* provided in the main body 21 on the side of the belt retainer 22, whereby the engagement between the engaging claws 13 provided on the inserts 11 of the male members 10 and the engaging claws 32 of the engaging member 30 provided in the female member 20 can be released by pressing the portion 34 of the engaging member 30 projecting through the window 23*a* upward, namely, by pressing it toward the inner wall 21*d*' located opposite and facing the belt retainer 22. Since the release can be achieved without applying pressure to the buckle B in the direction from the front surface 21*b* toward the rear surface 21*b*' of the female member 20, the wearer secured by the first, second and third belts B-1, B-2, B-3 joined by the buckle B does not experience any uncomfortable pressure on the abdomen.

In addition, the disengagement of the engaging claws 13, 32 and the release of the male members 10 from the female member 20 can be easily and reliably achieved merely by pressing upward on the portion 34 of the engaging member 30 projecting downward through the window 23*a*.

More specifically, the engagement can be reliably released merely by bringing at least two fingers of one hand toward the front surface 21*b* of the female member 20 of the buckle B, placing one finger on the side portion of the female member 20 which is disposed opposite from the belt retainer 22 of the female member 20, placing the other finger on the underside of the portion 34 of the engaging member 30 projecting downward through the window 23*a*, and squeezing the fingers toward each other.

Another feature of the buckle B according to the invention is that the engagement can be smoothly released by a straight pushing action applied to the portion 34 of the engaging member 30 projecting downward through the window 23*a*.

Moreover, since the window 23*a* is provided within a side portion extending between the sockets 21*a* of the female member 20 and on the side of the belt retainer 22 to which one end of the third belt B-3 is fastened, the portion 34 of the engaging member 30 projecting through the window 23*a* is safe from being contacted by other members, so that it is highly unlikely for the engagement between the male members 10 and the female member 20 to be unintentionally released due to pressure accidentally applied to the projecting portion 34 of the engaging member 30.

Obviously, many modification and variations of the present invention are possible in light of the above teachings. It is therefore to be understood that within the scope of the appended claims, the present invention may be practiced otherwise than as specifically described herein.

What is claimed is:

1. A buckle, comprising:

a female member comprising a main body portion; a pair of sockets defined within first and second opposite lateral sides of said main body portion; a belt retainer provided upon a third side of said main body portion for fastening one end of a first belt to said main body portion of said female member; a window opening defined within said third side of said main body portion; an engaging member movably disposed within said main body portion of said female member between said third side of said main body portion and a fourth side of said main body portion disposed opposite said third side of said main body portion, and provided with a pair of oppositely disposed, first engaging claws respectively disposed within said sockets of said main body portion, an operating projection, and means for biasing said engaging member away from said fourth side of said main body portion and toward said third side of said main body portion such that said operating projection of said engaging member extends through said window opening so as to be externally accessible; and a pair of male members having belt retainer means defined thereon for respectively fastening one end of second and third belts thereto; and inserts insertable into said sockets of said main body portion of said female member and having formed thereon second engaging claws for respectively engaging said first engaging claws of said engaging member of said female member when said pair of male members are respectively inserted into said pair of sockets formed within said main body portion of said female member, the engagement between said first and second engaging claws of said engaging member of said female member and said inserts of said pair of male members being releasable by moving said operating projection of said engaging member, extending through said window opening of said main body portion of said female member, away from said third side of said main body portion and toward said fourth side of said main body portion against the biasing force of said biasing means.

2. A buckle as set forth in claim 1, wherein:

said biasing means of said engaging member comprises a pair of elastic members integral with said engaging member and in contact with an interior wall portion of said main body portion disposed along said fourth side of said main body portion.

3. A buckle as set forth in claim 1, further comprising:

a finger hole defined within a front surface portion of said main body portion of said female member for permitting insertion of an operator's finger into said finger hole for gaining access to said operating projection of said engaging member which extends through said window opening of said main body portion of said female member.

4. A buckle as set forth in claim 1, wherein:

said pair of oppositely disposed first engaging claws and said operating projection are all integrally formed with said engaging member as a one-piece construction such that when said engaging member is moved away from said third side of said main body portion and toward said fourth side of said main body portion, as a result of said movement of said operating projection against said biasing force of said biasing means, said first engaging claws of said engaging member of said female member are simultaneously released from said second engaging claws of said inserts of said male members.

5. A buckle as set forth in claim 1, wherein:

said pair of male members are laterally symmetrical so as to be properly insertable within said pair of sockets defined within said first and second opposite lateral sides of said main body portion of said female member.

6. A buckle as set forth in claim 1, further comprising:

plate means fixed upon one side of each one of said second engaging claws of said inserts of said male members for engaging said front surface portion of said main body portion of said female member when said male members are inserted into said sockets of said main body portion of said female member so as to permit said inserts of said male members to be inserted into said sockets of said main body portion of said female member, and for engaging said first engaging claws of said engaging member, so as to prevent insertion of said inserts of said male members into said sockets of said main body portion of said female member, if said inserts of said male members are attempted to be inserted into said sockets of said main body portion of said female member in a backward orientation.

7. A buckle, comprising:

a female member comprising a main body portion which comprises left and right lateral side portions, top and bottom portions, and front and rear surface portions; a pair of sockets defined within said left and right lateral side portions; a belt retainer integral with said bottom portion and provided for fastening one end of a first belt to said main body portion of said female member; a window opening defined within said bottom portion of said main body portion; an engaging member movably disposed within said main body portion of said female member between said top and bottom portions so as to be alternatively disposable at first engaged and second disengaged positions, and provided with a pair of oppositely disposed, first engaging means respectively disposed within said sockets of said main body portion, and further provided with an operating projection; and means for biasing said engaging member away from said top portion of said main body portion and toward said bottom portion of said main body portion such that said operating projection of said engaging member extends through said window opening so as to be externally accessible; and a pair of male members comprising belt retainer means defined thereon for respectively fastening one end of second and third belts thereto, and inserts insertable into said sockets of said main body portion of said female member and having formed thereon second engaging means for respectively engaging said first engaging means of said engaging member of said female member when said pair of inserts of said male members are respectively inserted into said pair of sockets formed within said main body portion of said female member, the engagement between said first and second engaging means of said engaging member of said female member and said inserts of said pair of male members being releasable by moving said operating projection of said engaging member, extending through said window opening of said main body portion of said female member, away from said bottom portion of said main body portion and toward said top portion of said main body portion against the biasing force of said biasing means.

8. A buckle as set forth in claim 7, wherein:

said biasing means comprises a pair of elastic members integral with said engaging member and in contact with an interior wall portion of said main body portion disposed along said top portion of said main body portion.

9. A buckle as set forth in claim 7, further comprising:

a finger hole defined within said front surface portion of said main body portion of said female member for permitting insertion of an operator's finger into said front surface portion of said main body portion and thereby gaining access to said operating projection of said engaging member which extends through said window opening of said bottom portion of said main body portion of said female member.

10. A buckle as set forth in claim 7, wherein:

said pair of oppositely disposed first engaging means and said operating projection of said engaging member are integrally formed together as a one-piece construction such that when said engaging member is moved away from said bottom portion of said main body portion and toward said top portion of said main body portion, as a result of said movement of said operating projection against said biasing force of said biasing means, said first engaging means of said engaging member of said female member are simultaneously released from said second engaging means of said inserts of said male members.

11. A buckle as set forth in claim 7, wherein:

said pair of male members are laterally symmetrical so as to be properly insertable within said pair of sockets defined within said left and right lateral side portions of said main body portion of said female member.

12. A buckle as set forth in claim 7, further comprising:

plate means fixed upon one side of each one of said inserts of said male members for engaging said front surface portion of said main body portion of said female member when said male members are inserted into said sockets of said main body portion of said female member so as to permit said inserts of said male members to be inserted into said sockets of said main body portion of said female member whereby said second engaging means of said inserts of said male members can engage said first engaging means of said engaging member of said female member; and for engaging said first engaging means of said engaging member of said female member so as to prevent insertion of said inserts of said male members into said sockets of said main body portion of said female member if said inserts of said male members are attempted to be inserted into said sockets of said main body portion of said female member in a backward orientation.

13. A buckle, comprising:

a female member comprising a main body portion; a pair of sockets defined within said main body portion; a belt retainer provided upon one side edge portion of said main body portion for fastening one end of a first belt to said main body portion of said female member; a window opening defined within said main body portion; an engaging member movably disposed within said main body portion of said female member between said one side edge portion of said main body portion and an opposite side edge portion of said main body portion, and provided with a pair of engaging means respectively disposed within said sockets of said main body portion, and an operating projection; and means for biasing said engaging member in a direction extending between said one side edge portion of said main body portion and said opposite side edge portion of said main body portion such that said engaging member is biased toward an engaged position and said operating projection of said engaging member extends through said window opening so as to be externally accessible; and a pair of male members having belt retainer means defined thereon for respectively fastening one end of second and third belts thereto; and inserts insertable into said sockets of said main body portion of said female member and having formed thereon second engaging means for respectively engaging said first engaging means of said engaging member of said female member when said pair of inserts of said male members are respectively inserted into said pair of sockets formed within said main body portion of said female member, the engagement between said first and second engaging means of said engaging member of said female member and said inserts of said pair of male members being releasable by moving said operating projection of said engaging member, extending through said window opening of said main body portion of said female member, and said engaging member away from said engaged position and against the biasing force of said biasing means toward a disengaged position.

14. A buckle as set forth in claim 13, wherein:

said biasing means comprises a pair of elastic members which are integral with said engaging member and which are disposed in contact with an interior wall portion of said main body portion which is disposed along said opposite side edge portion of said main body portion of said female member such that said engaging member is biased toward said one side edge portion of said main body portion along which said belt retainer of said female member is disposed.

15. A buckle as set forth in claim 13, further comprising:

a finger hole defined within a front surface portion of said main body portion of said female member for permitting insertion of an operator's finger through said front surface portion of said main body portion so as to thereby gain access to said operating projection of said engaging member which extends through said window opening of said main body portion of said female member.

16. A buckle as set forth in claim 15, further comprising:

plate means fixed upon one side of each one of said inserts of said male members for engaging said front surface portion of said main body portion of said female member when said male members are inserted into said sockets of said main body portion of said female member so as to permit said inserts of said male members to be inserted into said sockets of said main body portion of said female member whereby said second engaging means of said inserts of said male members can engage said first engaging means of said engaging member of said female member; and for engaging said first engaging means of said engaging member of said female member so as to prevent insertion of said inserts of said male members into said sockets of said main body portion of said female member if said inserts of said male members are attempted to be inserted into said sockets of said main body portion of said female member in a backward orientation.

17. A buckle as set forth in claim 13, wherein:

said pair of first engaging means of said engaging member and said operating projection of said engaging member are integrally formed together as a one-piece construction such that when said engaging member is moved away from said engaged position and toward said disengaged position, as a result of said movement of said operating projection against said biasing force of said biasing means, said first engaging means of said engaging member of said female member are simultaneously released from engagement with said second engaging means of said inserts of said male members.

18. A buckle as set forth in claim 13, wherein:

said pair of sockets defined within said main body portion of said female member are defined within left and right lateral side portions of said main body portion of said female member; and said pair of male members are laterally symmetrical so as to be properly insertable within said pair of sockets defined within said left and right lateral side portions of said main body portion of said female member.

* * * * *